US009333765B2

(12) United States Patent
Moto et al.

(10) Patent No.: US 9,333,765 B2
(45) Date of Patent: May 10, 2016

(54) THERMAL HEAD AND THERMAL PRINTER EQUIPPED WITH THE THERMAL HEAD

(71) Applicant: KYOCERA Corporation, Kyoto-shi, Kyoto (JP)

(72) Inventors: Youichi Moto, Kyoto (JP); Takahiro Murata, Kyoto (JP); Hidenobu Nakagawa, Kyoto (JP); Takahiro Shimozono, Kyoto (JP); Iwao Kobayashi, Kyoto (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 14/443,877

(22) PCT Filed: Nov. 15, 2013

(86) PCT No.: PCT/JP2013/080895
§ 371 (c)(1),
(2) Date: May 19, 2015

(87) PCT Pub. No.: WO2014/080843
PCT Pub. Date: May 30, 2014

(65) Prior Publication Data

US 2015/0298464 A1 Oct. 22, 2015

(30) Foreign Application Priority Data

Nov. 20, 2012 (JP) ..... 2012-254375

(51) Int. Cl.
*B41J 2/335* (2006.01)

(52) U.S. Cl.
CPC ..... *B41J 2/3351* (2013.01); *B41J 2/3352* (2013.01); *B41J 2/3353* (2013.01); *B41J 2/3354* (2013.01); *B41J 2/3357* (2013.01); *B41J 2/33505* (2013.01)

(58) Field of Classification Search
USPC ..... 347/200, 209, 211
See application file for complete search history.

(56) References Cited

U.S. PATENT DOCUMENTS

| | | | | |
|---|---|---|---|---|
| 6,034,706 | A | 3/2000 | Nagahata | |
| 6,907,656 | B1 * | 6/2005 | Saita et al. | 29/611 |

FOREIGN PATENT DOCUMENTS

| | | | |
|---|---|---|---|
| JP | 02-043059 | A | 2/1990 |
| JP | 2-76037 | U | 6/1990 |
| JP | 08-281990 | A | 10/1996 |
| JP | 2000-103104 | A | 4/2000 |
| JP | 2004-230582 | A | 8/2004 |
| JP | 2005-219408 | A | 8/2005 |
| WO | 97/45270 | A1 | 12/1997 |

OTHER PUBLICATIONS

International Search Report, PCT/JP2013/080895, Feb. 18, 2014, 2 pgs.

* cited by examiner

*Primary Examiner* — Huan Tran
(74) *Attorney, Agent, or Firm* — Volpe and Koenig, P.C.

(57) ABSTRACT

A thermal head capable of decreasing the possibility of causing a blur in an image printed on a recording medium is provided. A thermal head includes: a substrate; a plurality of heat generating portions disposed aligned on the substrate; an electrode disposed on the substrate so as to be electrically connected to the heat generating portions; a driving IC electrically connected to the electrode; and a covering member which covers the driving IC and makes contact with a recording medium which is being conveyed. The covering member includes: a first protrusion extending in a direction away from the substrate; and a second protrusion which is spaced from the first protrusion, is located between the first protrusion and the heat generating portions, and extends in a direction away from the substrate.

20 Claims, 12 Drawing Sheets

THERMAL HEAD AND THERMAL PRINTER EQUIPPED WITH THE THERMAL HEAD

TECHNICAL FIELD

The present invention relates to a thermal head and a thermal printer equipped with the thermal head.

BACKGROUND ART

Various types of thermal heads have been proposed to date as printing devices for use in facsimiles, video printers, and so forth. For example, there is known a thermal head comprising: a substrate; a plurality of heat generating portions disposed aligned on the substrate; an electrode disposed on the substrate so as to be electrically connected to the heat generating portions; a driving IC electrically connected to the electrode; and a covering member which covers the driving IC and makes contact with a recording medium which is being conveyed (refer to Patent Literature 1, for example).

CITATION LIST

Patent Literature

Patent Literature 1: Japanese Unexamined Patent Publication JP-A 2005-219408

SUMMARY OF INVENTION

Technical Problem

In the conventional thermal head as above described, however, during conveyance of a recording medium over the covering member, friction between the recording medium and the covering member is so great that the recording medium may not be conveyed smoothly onto the heat generating portion. This gives rise to the possibility of causing a blur in an image printed on the recording medium.

Solution to Problem

A thermal head in accordance with one embodiment of the invention includes: a substrate; a plurality of heat generating portions disposed aligned on the substrate, an electrode disposed on the substrate so as to be electrically connected to the heat generating portions; a driving IC electrically connected to the electrode; and a covering member which covers the driving IC and makes contact with a recording medium which is being conveyed. Moreover, the covering member includes: a first protrusion extending in a direction away from the substrate; and a second protrusion which is spaced from the first protrusion, is located between the first protrusion and the heat generating portions, and extends in a direction away from the substrate.

A thermal printer in accordance with one embodiment of the invention includes: the thermal head mentioned above; a conveyance mechanism of conveying the recording medium onto the heat generating portions; and a platen roller which presses the recording medium onto the heat generating portions.

Advantageous Effects of Invention

According to the invention, it is possible to decrease the possibility of causing a blur in an image printed on a recording medium.

BRIEF DESCRIPTION OF DRAWINGS

FIG. 8(*b*) is a sectional view taken along the line V-V shown in FIG. 6; and FIG. 8(*c*) is a sectional view taken along the line VI-VI shown in. FIG. 6;

FIG. 14 (*b*) is a sectional view taken along the line IX-IX shown in FIG. 6; and FIG. 14(*c*) is a sectional view taken along the line X-X shown in FIG. 6.

DESCRIPTION OF EMBODIMENTS

First Embodiment

Figure 1:
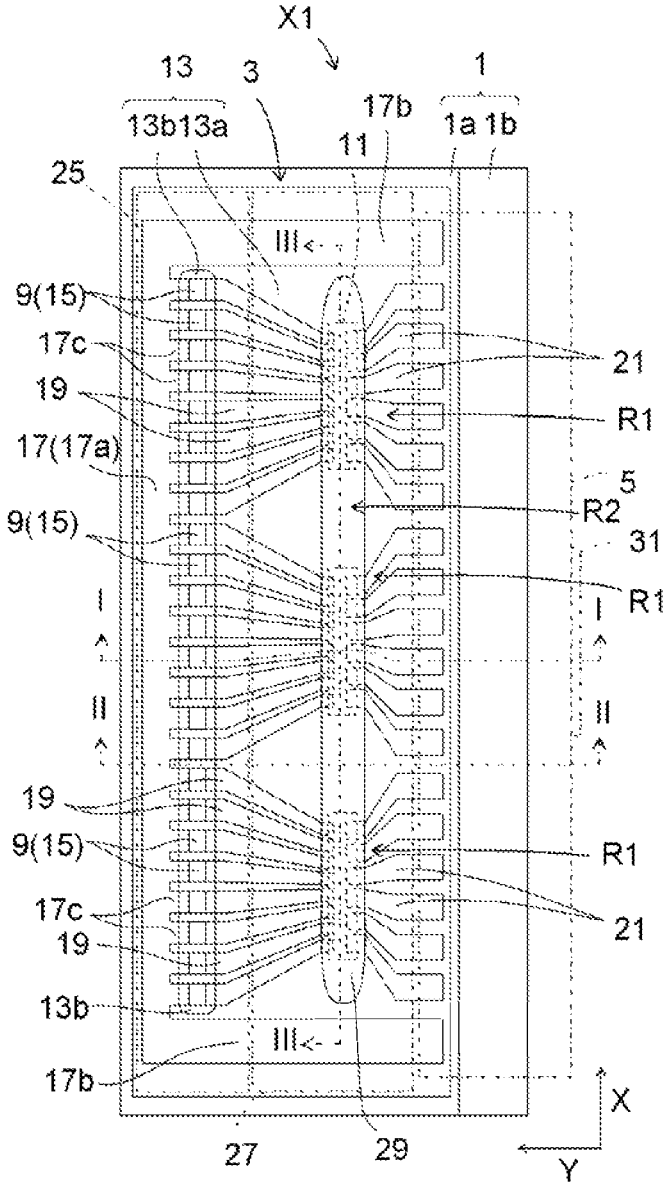
FIG. 1 is a plan view schematically showing a structure of a thermal head in accordance with a first embodiment.

Hereinafter, a thermal head X1 will foe described with reference to FIGS. 1 to 4. The thermal head X1 comprises: a heatsink 1; a head substrate 3 placed on the heatsink 1; and a flexible printed wiring board 5 (hereafter referred to as MFPC 5") connected to the head substrate 3. In FIG. 1, the diagrammatic representation of the FPC 5 is omitted, and, a region where the FPC 5 is placed is indicated by alternate long and short dashed lines. Moreover, a main scanning direction X, a sub scanning direction Y, and a thickness direction 2 are shown in those drawings. Furthermore, in FIGS. 2, 3, 5, 8, 10, and 14, there is shown a conveyance direction S in which a recording medium is conveyed.

The heatsink 1 has the form of a plate, and, in a plan view, it is rectangular-shaped. The heatsink 1 comprises: a plate-like base portion 1*a*; and a projection portion 1*b* protruding from the base portion 1*a*. The heatsink 1 is made of a metal material such for example as copper, iron, or aluminum, and has the capability of dissipating, of heat generated by a heat generating portion 9 of the head substrate 3, heat which is not conducive to printing. Moreover, the head substrate 3 is bonded to an upper surface of the base portion 1*a* by means of double-faced tape, an adhesive, or otherwise (not shown).

In a plan view, the head substrate 3 has the form of a plate, and, constituent members of the thermal head X1 are each disposed on a substrate 7 of the head substrate 3. The head substrate 3 has the function of performing printing on a recording medium P (refer to FIG. 3) in response to an externally-supplied electric signal.

The FPC 5 is a wiring board which is electrically connected to the head substrate 3 so as to have the function of feeding electric current and electric signals to the head substrate 3. The FPC 5 is connected to a connection electrode 21 of the head substrate 3 via an electrically conductive joining material 23. Thus, electrical connection is established between the head substrate 3 and the FPC 5. Materials that exemplify the electrically conductive joining material 23 include a solder material and an anisotropic conductive film (ACF).

A reinforcing plate made of resin such for example as a phenol resin, a polyimide resin, or a glass epoxy resin (not shown) may be disposed between the FPC 5 and the heatsink 1. The reinforcing plate may also be joined to the entire area of the FPC 5. The FPC 5 can be reinforced by bonding the reinforcing plate to a lower surface thereof by means of double-faced tape, an adhesive, or otherwise.

Although the FPC 5 is used as the wiring board in the illustrated example, a hard wiring board may be used instead of the FPC 5 which exhibits flexibility. Components that exemplify the hard printed wiring board include a glass epoxy board and a resin-made board such as a polyimide board. Moreover, wire bonding may be adopted as means for providing electrical connection between the wiring board and the head substrate 3.

Hereinafter, each of members constituting the head substrate 3 will be described.

The substrate 7 is made of an electrically insulating material such for example as alumina ceramics, or a semiconductor material such for example as single-crystal silicon.

A heat storage layer 13 is formed on an upper surface of the substrate 7. The heat storage layer 13 comprises an underlayer portion 13*a* and a protuberant portion 13*b*. The underlayer portion 13*a* is formed over the entire area of the upper surface of the substrate 7. The protuberant portion 13*b* extends in the form of a strip along the main scanning direction X, and has a substantially semi-elliptical sectional profile. The protuberant portion 13*b* acts to press a recording medium which is subjected to printing against a protective layer 25 formed on the heat generating portion 9 in a satisfactory manner.

The heat storage layer 13, which is made of glass having a low heat conductivity, is capable of shortening the time required for a temperature rise in the heat generating portion 9, and acts to improve the thermal response characteristics of the thermal head X1. For example, the heat storage layer 13 is formed by applying a predetermined glass paste onto the upper surface of the substrate 7 by means of heretofore known screen printing or otherwise, and subsequently firing the paste.

An electrical resistance layer 15 is disposed on an upper surface of the heat storage layer 13, and, on the electrical resistance layer 15 are disposed a common electrode 17, an individual electrode 19, and a connection electrode 21. The electrical resistance layer 15 is subjected to patterning so as to have the same shape as the common electrode 11, the individual electrode 19, and the connection electrode 21, and is formed in a manner such that an exposed electrical-resistance layer 15 region can be provided between the common electrode 17 and the individual electrode 19.

As shown in FIG. 1, there are arranged exposed regions of the electrical-resistance layer 15 in an array along the main scanning direction X on the protuberant portion 13*b*, and, each of the exposed regions constitutes the heat generating portion 9. A plurality of heat generating portions 9, while being illustrated in simplified form in FIG. 1 for convenience in explanation, are arranged at a density of 600 to 2400 dpi (dot per inch), for example.

The electrical resistance layer 15 is made of a material having a relatively high electrical resistance such for example as a TaN-based material, a TaSiO-based material, a TaSiNO-based material, a TiSiO-based material, a TiSiCO-based material, or a NbSiO-based material.

Figure 2:
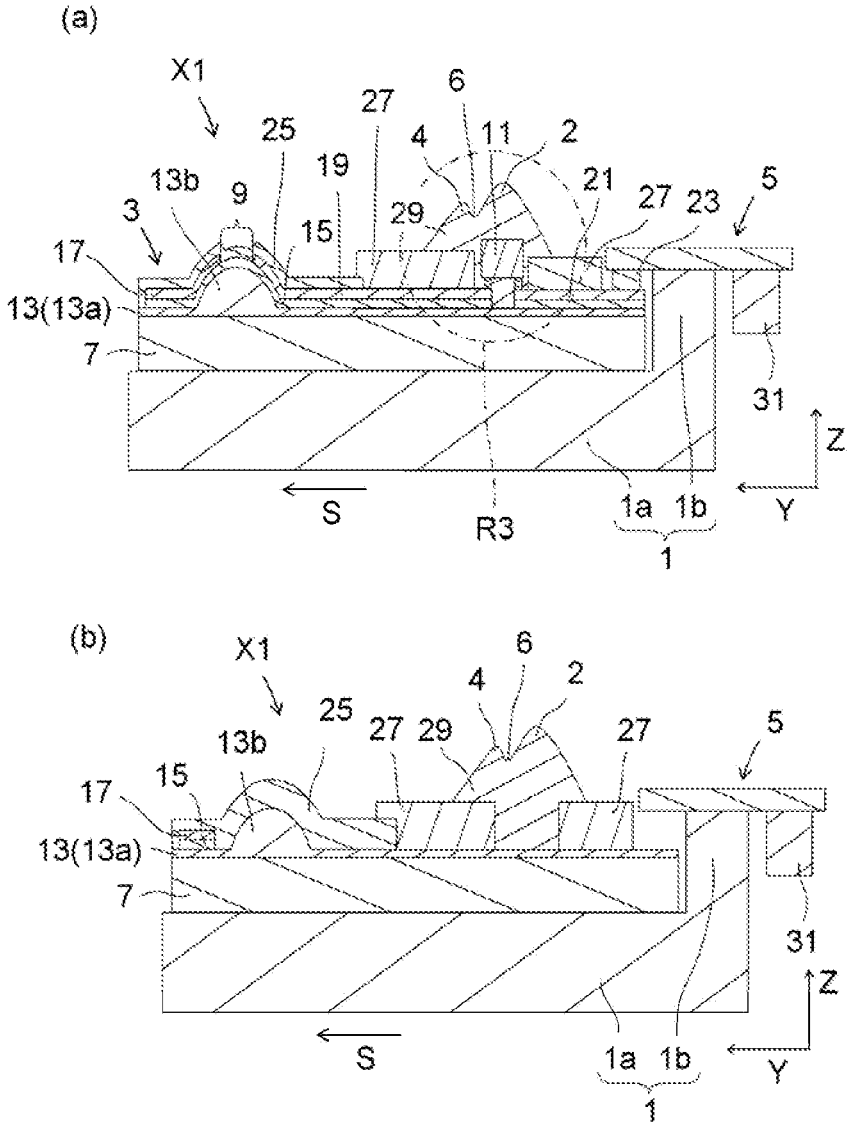
FIG. 2(*a*) is a sectional view taken along the line I-I shown in FIG. 1, and FIG. 2(*b*) is a sectional view taken along the line II-II shown in FIG. 1.

As shown in FIGS. 1 and 2, the common electrode 17, a plurality of individual electrodes 19, and a plurality of connection electrodes 21 are disposed on an upper surface of the electrical resistance layer 15. The common electrode 17, the individual electrodes 19, and the connection electrodes 21 are made of a material having electrical conductivity, for example, one metal material selected from among aluminum, gold, silver, and copper, or an alloy of these metals.

The common electrode 17 comprises: a main wiring portion 17*a*; a plurality of sub wiring portions 17*b*; and a plurality of lead portions 17*c*. The main wiring portion 17*a* extends along one longer side of the substrate 7. The sub wiring portions 17*b* extend along one and the other shorter sides, respectively, of the substrate 7. The lead portions 17*c* extend individually from the main wiring portion 17*a* toward each of the heat generating portions 9. One end of the common electrode 17 is connected to a plurality of heat generating portions 9, and other end thereof is connected to the FPC 5, thereby permitting electrical connection of the FPC 5 with each of the heat generating portions 9.

The plurality of individual electrodes 19 have their one ends connected to the heat generating portion 9, and have their other ends connected to a driving IC 11, thereby permitting electrical connection of the driving IC 11 with each of the heat generating portions 9. Moreover, given that the heat generating portions 9 are bunched together in groups, the individual electrodes 19 allow the heat generating portions 9 in each group to make electrical connection with a corresponding one of the driving ICs 11 prepared for their respective heat generating portion groups.

The plurality of connection electrodes 21 have their one ends connected to the driving IC 11, and have their other ends connected to the FPC 5, thereby permitting electrical connection of the driving IC 11 with the FPC 5. The plurality of connection electrodes 21 connected to each of the driving ICs 11 are constructed of a plurality of wiring lines having different functions.

As shown in FIG. 1, the driving IC 11 is placed in correspondence to each of the groups including a plurality of heat generating portions 9, and is connected to the other end of the individual electrode 19 and one end of the connection electrode 21. The driving IC 11 has the function of controlling the current-carrying state of each of the heat generating portions 9.

The electrical resistance layer 15, the common electrode 17, the individual electrode 19, and the connection electrode 21 thus far described are formed by, for example, laminating layers of their constituent materials on the heat storage layer 13 one after another by a heretofore known thin-film forming technique such as a sputtering method, and subsequently working the resultant layered body into predetermined patterns by a heretofore known technique such as a photo-etching method. The common electrode 17, the individual electrode 19, and the connection electrode 21 can be formed at one time through the same process steps.

As shown in FIGS. 1 and 2, a protective layer 25 for covering the heat generating portion 9, part of the common electrode 17, and part of the individual electrode 19 is formed on the heat storage layer 13 formed on the upper surface of the substrate 7. In FIG. 1, for convenience in explanation, a region where the protective layer 25 is formed is indicated by alternate long and short dashed lines, and its diagrammatic representation is omitted.

The protective layer 25 is intended to protect the covered areas of the heat generating portion 9, the common electrode 17, and the individual electrode 19 against corrosion caused by adhesion of, for example, atmospheric water content, or against wear caused by contact with a recording medium which is subjected to printing. The protective layer 25 can be formed from SiN, SiO, SiON, SiC, diamond-like carbon, or the like, and, the protective layer 25 may be given either of a single-layer structure or a multi-layer structure. Such a protective layer 25 can be produced by a thin-film forming technique such as the sputtering method, or a thick-film forming technique such as a screen printing method.

Moreover, as shown in FIGS. 1 and 2, a cover layer 27 for partly covering the common electrode 17, the individual electrode 19, and the connection electrode 21 is disposed on the underlayer portion 13*a* of the heat storage layer 13 formed on the upper surface of the substrate 7. In FIG. 1, for convenience in explanation, a region where the cover layer 27 is formed is indicated by alternate long and short dashed lines. The cover layer 27 is intended to protect the covered areas of the common electrode 17, the individual electrode 19, and the connection electrode 21 against corrosion caused by, for example, contact with atmosphere or adhesion of atmospheric water content.

The cover layer 27 is formed with an opening for leaving the individual electrode 19, as well as the connection electrode 21 connected to the driving IC 11 exposed (not shown), so that the wiring lines can be connected to the driving IC 11 through the opening. The cover layer 27 can be formed from a resin material such for example as an epoxy resin or a polyimide resin using a thick-film forming technique such as the screen printing method.

The driving IC 11 is, in a state of being connected to the individual electrode 19 and the connection electrode 21, covered while being sealed with a covering member 29 for the sake of protection of the driving IC 11 and also protection of the area where the driving IC 11 and the wiring lines are connected to each other.

Figure 3:
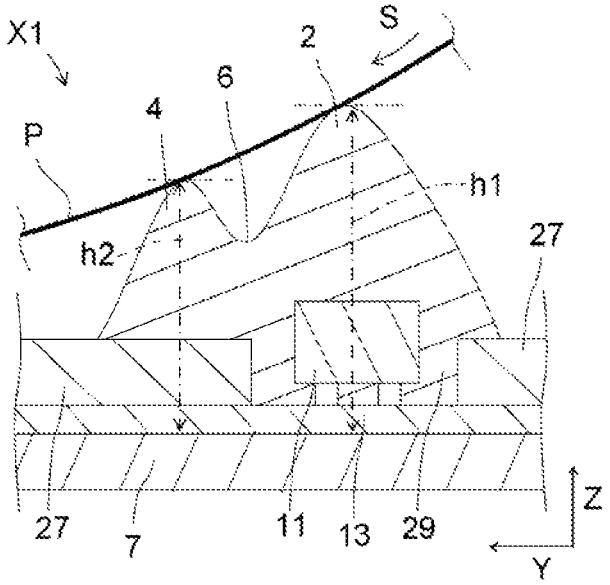
FIG. 3 is an enlarged sectional view of a region R3 shown in FIG. 2(*a*)
Figure 4:
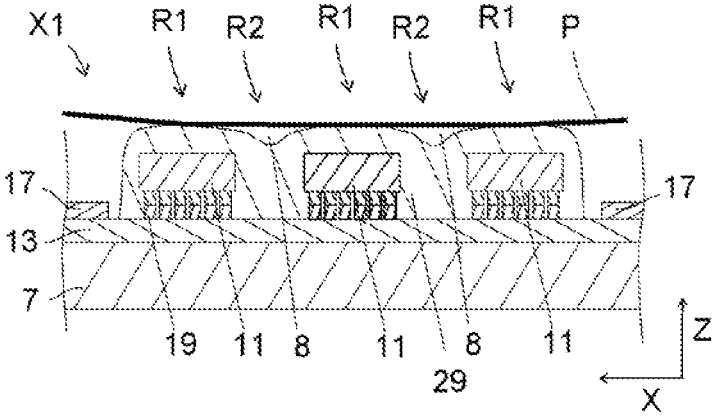
FIG. 4 is a sectional view taken along the line III-III shown in FIG. 1.

The covering member 29 is disposed so as to extend in the main scanning direction X while straddling over the a plurality of driving ICs 11. As shown in FIGS. 2 to 4, the covering member 29 comprises a first protrusion 2 and a second protrusion 4. The first protrusion 2 extends in a direction away from the substrate 7. The second protrusion 4 is spaced from the first protrusion 2, is located between the first protrusion 2 and the heat generating portion 9, and extends in a direction away from the substrate 7. In other words, the first protrusion 2 and the second protrusion 4 are each in an upwardly-protruding state. Moreover, the covering member 29 has a recess 6 existing between the first protrusion 2 and the second protrusion 4.

Referring to FIGS. 3 and 4, the covering member 29 will be described in detail. In FIG. 4, for convenience in explanation, various electrodes disposed on the substrate 7 are omitted. This holds true for FIGS. 7, 8, 13, and 14.

The first protrusion 2 protrudes in a direction of the thickness of the substrate 7 (hereafter also referred to as "thickness direction Z") by an amount of h1 representing a protruding height. The second protrusion 4 protrudes in the thickness direction 2 by an amount of h2 representing a protruding height. As employed herein, the term "protruding height" refers to the level of protrusion with respect to the substrate 7, and, it can be measured by means of a contact type or non-contact type surface roughness meter.

Thus, since the first protrusion 2 and the second protrusion 4 protrude in a direction toward the recording medium P, it follows that the recording medium P is conveyed in contact with the first protrusion 2 and the second protrusion 4.

The concave recess 6 is situated between the first protrusion 2 and the second protrusion 4, looking toward a downstream side from an upstream side in the sub scanning direction Y, and, as the recording medium P is being carried from an upstream side toward a downstream side in the sub scanning direction Y, the recording medium P makes contact with the first protrusion 2, and subsequently makes contact with the second protrusion 4 without making contact with a part of the covering member 29 which is formed with the recess 6.

That is, as shown in FIG. 3, the covering member 29 does not make surface contact, but makes point contact with the recording medium F at the first protrusion 2 and the second protrusion 4. This makes it possible to decrease the possibility that the frictional force developed between the recording medium P and the covering member 29 will increase, and thereby achieve smooth conveyance of the recording medium F onto the heat generating portion 9. As a result, the possibility of causing a contact failure between the recording medium F and the protective layer 25 formed on the heat generating portion S can be decreased, which leads to a decrease in the possibility of causing a blur in an image printed on the recording medium P.

Moreover, since the covering member 29 comprises the first protrusion 2 and the second protrusion 4, even when the covering member 29 makes point contact with the recording medium P at the first protrusion 2, it is possible to disperse the contact stress by the second protrusion 4, and thereby decrease the possibility of causing wrinkles in the recording medium P, as well as the possibility of causing damage to the recording medium P.

The protruding height h1 of the first protrusion 2 with respect to the substrate 7 is greater than the protruding height h2 of the second protrusion 4 with respect to the substrate 7. That is, in this structure, the first protrusion 2 located on the upstream side in the sub scanning direction Y is greater in height than the second protrusion 4 located on the downstream side in the sub scanning direction Y. Therefore, as the recording medium P is being carried from the upstream side toward the downstream side in the sub scanning direction Y, the distance between the recording medium. P and the substrate 7 can be gradually shortened, and eventually the level at which the recording medium P is positioned can be approximated to the height of the heat generating portion 9 from the substrate 7, thereby achieving smooth conveyance of the recording medium P toward the heat generating portion 9.

It is preferable that the value of h2/h1 falls in the range of 0.73 to 1.5. The above-mentioned advantageous effect can be obtained by adjusting h2/h1 to fall in the range of 0.73 to 1.5. Moreover, also in a case where h2/h1 falls in the range of 1.0 to 1.5, the recording medium P can be conveyed smoothly by the second protrusion 4 and the first protrusion 2.

Moreover, in the covering member 29, the recess 6 lies between the first protrusion 2 and the second protrusion 4. Therefore, even if a surface treatment agent (not shown) provided on the surface of the recording medium P is scraped off from the recording medium P due to the contact between the first protrusion 2 and the recording medium P with consequent generation of paper debris, the paper debris can be stored in the recess 6. This helps decrease the possibility of delivering paper debris to the heat generating portion 9.

As shown in FIG. 3, it is preferable that the driving IC 11 is located in a lower part of the first protrusion 2. That is, in the present embodiment, the protruding end of the first protrusion 2 is situated above the driving IC 11.

There may be a case where heat generated at the time of driving the driving IC 11 is transmitted from the first protrusion 2 to the recording medium P. If excessive heat is transmitted to the recording medium P, the surface condition of the recording medium P may be deteriorated.

The thermal head X1 is constructed so that the driving IC 11 is located in a lower part of the first protrusion 2 located on the upstream side in the sub scanning direction Y, wherefore a sufficient amount of the covering member 29 is placed between the driving IC and the recording medium P. This makes it possible to restrain heat emanating from the driving IC from being excessively transmitted to the recording medium P, and thereby decrease the possibility of causing deterioration in the surface condition of the recording medium P.

Moreover, the protruding end of the first protrusion 2 is situated above the driving IC 11. Therefore, the amount of the covering member 29 to be located above the driving IC 11 can be increased. This makes it possible to decrease the possibility of causing a shortage in the amount of the covering member 29 existing above the driving IC 11, and thereby decrease the possibility of causing breakage of the driving IC 11. From the viewpoint of contact stress dispersion, it is particularly preferable that, in a plan view, the protruding end of the first protrusion 2 is located above the center of gravity of the driving IC 11.

It is preferable that the covering member 29 is disposed along the main scanning direction X so as to straddle over the two or more driving ICS 11. That is, as shown in FIG. 4, in the case of disposing the covering member 29 so as to straddle over the plurality of driving ICs 11, a gap 8 is created between the recording medium P and the covering member 29.

In fact, the covering member 29 is situated in each of a region R1 located above the driving IC 11 and a region R2 other than the region R1. The height of the covering member 29 lying in the region R2 is less than the height of the covering member 29 lying in the region R1, and thus the gap 8 appears upon conveyance of the recording medium P.

In the presence of the gap 8 between the recording medium P and the covering member 29, the area of contact between the recording medium P and the covering member 29 is reduced, and it is possible to achieve further reduction in the frictional force developed between the recording medium P and the covering member 29. Moreover, in the presence of the gap 8 between the recording medium P and the covering member 29, the recording medium P becomes detached from the covering member 29 at a part thereof located above the gap 8 during conveyance, wherefore the recording medium P can be separated smoothly from the covering member 29.

Moreover, the covering member 29 lying in the region R1 is greater in height than the covering member 29 lying in the region R2, wherefore the amount of the covering member 29 lying in the region R1, or equivalently the amount of the covering member 29 situated above the driving IC 11 can be set at a sufficient level.

The covering member 29 can be made of resin such for example as an epoxy resin or a silicone resin. The first protrusion 2 and the second protrusion 4 may either be made of the same material or be made of different materials. For example, by forming the first protrusion 2 from a material which is higher in hardness than a material used to form the second protrusion 4, it is possible to decrease the possibility that the first protrusion 2 will wear more greatly than does the second protrusion 4.

For example, the covering member 29 comprising the first protrusion 2 and the second protrusion 4 can be produced in the following manner.

At first, an epoxy resin for forming the first protrusion 2 is applied onto the cover layer 27 by means of a dispenser or otherwise. At this time, it is desirable to apply the resin so as to cover the driving IC 11. Then, the epoxy resin coating is dried. Note that the application of epoxy resin may also be effected through printing.

Next, an epoxy resin for forming the second protrusion 4 is applied onto the cover layer 27 and the first protrusion 2. Specifically, the epoxy resin is applied by a dispenser so as to cover the heat generating portion 9—side edge of the first protrusion 2. Then, the epoxy resin coating is dried, and subsequently, the epoxy resins constituting the first protrusion 2 and the second protrusion 4 are thermally cured. In this way, the covering member 29 can be formed.

Alternatively, the epoxy resin for forming the first protrusion 2 may be thermally cured after application prior to application of the epoxy resin for forming the second protrusion 4, or, these epoxy resins may be applied at the same time with use of two dispensers after making adjustment to their viscosities.

Thus, since the covering member 29 is disposed so as to extend in the main scanning direction X, it is possible to produce the covering member 29 in one-piece form by one-time epoxy resin application using a dispenser or through a printing process, and thereby facilitate the manufacture of the thermal head X1.

Next, a thermal printer Z1 will be described with reference to FIG. 5.

Figure 5:
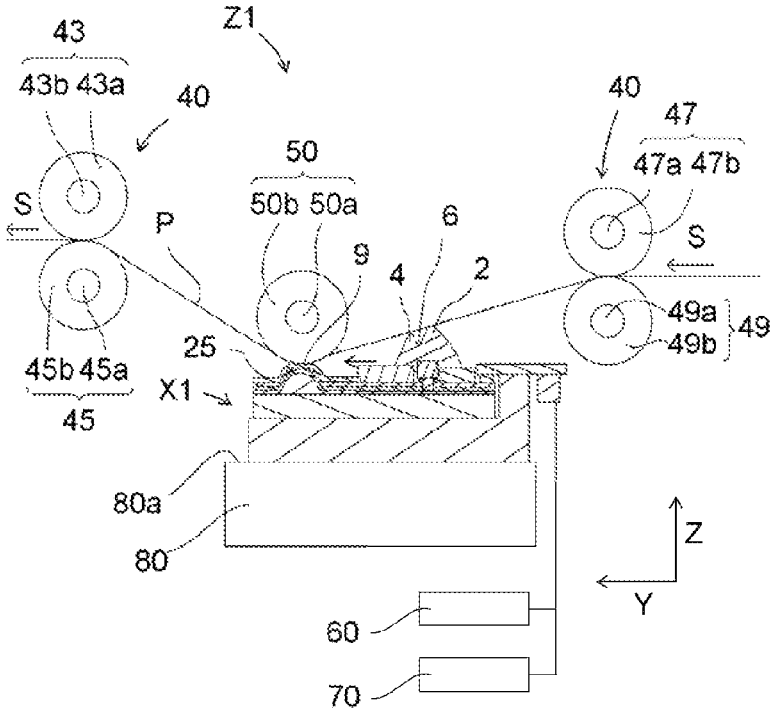
FIG. 5 is a view schematically showing a structure of a thermal printer in accordance with the first embodiment.

As shown in FIG. 5, the thermal printer Z1 of the present embodiment comprises: the thermal head X1 thus far described; a conveyance mechanism 40; a platen roller 50; a power-supply device 60; and a control device 70. The thermal head X1 is attached to a mounting surface 20*a* of a mounting member 80 disposed in a casing (not shown) for the thermal printer Z1.

The conveyance mechanism 40 comprises: a driving section (not shown); and conveying rollers 43, 45, 47, and 49. The conveyance mechanism 40 is intended to carry the recording medium P such for example as thermal paper or ink-transferable image-receiving paper in a direction indicated by arrow S in FIG. 5 so that the recording medium P can be conveyed onto the protective layer 25 situated on a plurality of heat generating portions 9 of the thermal head X1. The driving section has the function of driving the conveying rollers 43, 45, 47, and 49, and, for example, a motor may be used as the driving section.

The conveying rollers 43, 45, 47, and 49 can be constructed of, for example, cylindrical shaft bodies 43*a*, 45*a*, 47*a*, and 49*a* made of metal such as stainless steel covered with elastic members 43*b*, 45*b*, 47*b*, and 49*b* made of butadiene rubber or the like, respectively. Although not shown in the drawing, in a case where the recording medium P is ink-transferable image-receiving paper or the like, an ink film is interposed between the recording medium P and the heat generating portions 9 of the thermal head X1, and thus the recording medium P and the ink film are conveyed together.

The platen roller 50 has the function of pressing the recording medium P onto the protective layer 25 situated on the heat generating portions 9 of the thermal head X1. The platen roller 50 is disposed so as to extend along the main scanning direction X, and is supported at ends thereof so as to be rotatable while pressing the recording medium P onto the heat generating portion 9. For example, the platen roller 50 can be constructed of a cylindrical shaft body 50*a* made of metal such as stainless steel covered with an elastic member 50*b* made of butadiene rubber or the like.

The power-supply device 60 has the function of supplying electric current for allowing the heat generating portion 9 of the thermal head X1 to generate heat, as well as electric current for operating the driving IC 11. The control device 70 has the function of feeding a control signal for controlling the operation of the driving IC 11 to the driving IC 11 in order for the heat generating portions 9 of the thermal head X1 to generate heat in a selective manner.

In the thermal printer Z1, as shown in FIG. 5, the recording medium P is conveyed onto the heat generating portions 9 of the thermal head X1 by the conveyance mechanism 40 while being pressed onto the heat generating portions 9 by the platen roller 50, and, the heat generating portions 9 are allowed to generate heat in a selective manner by the power-supply device 60 and the control device 70, whereby predetermined printing can be performed on the recording medium P. In a case where the recording medium P is image-receiving paper or the like, printing is performed on the recording medium P by effecting thermal transfer of the ink of an ink film (not shown) being conveyed together with the recording medium P onto the recording medium P.

Second Embodiment

Figure 6:
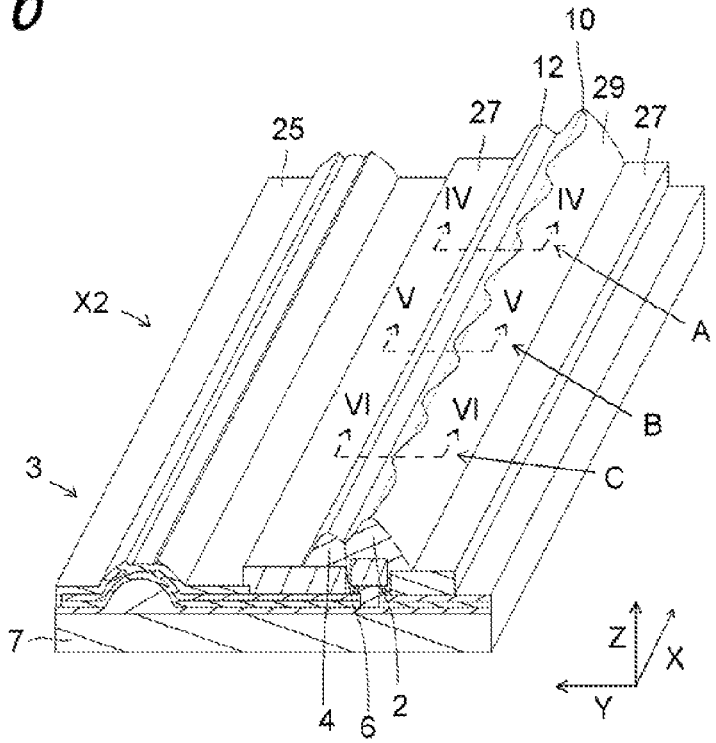
FIG. 6 is a perspective view of a thermal head in accordance with a second embodiment.
Figure 7:
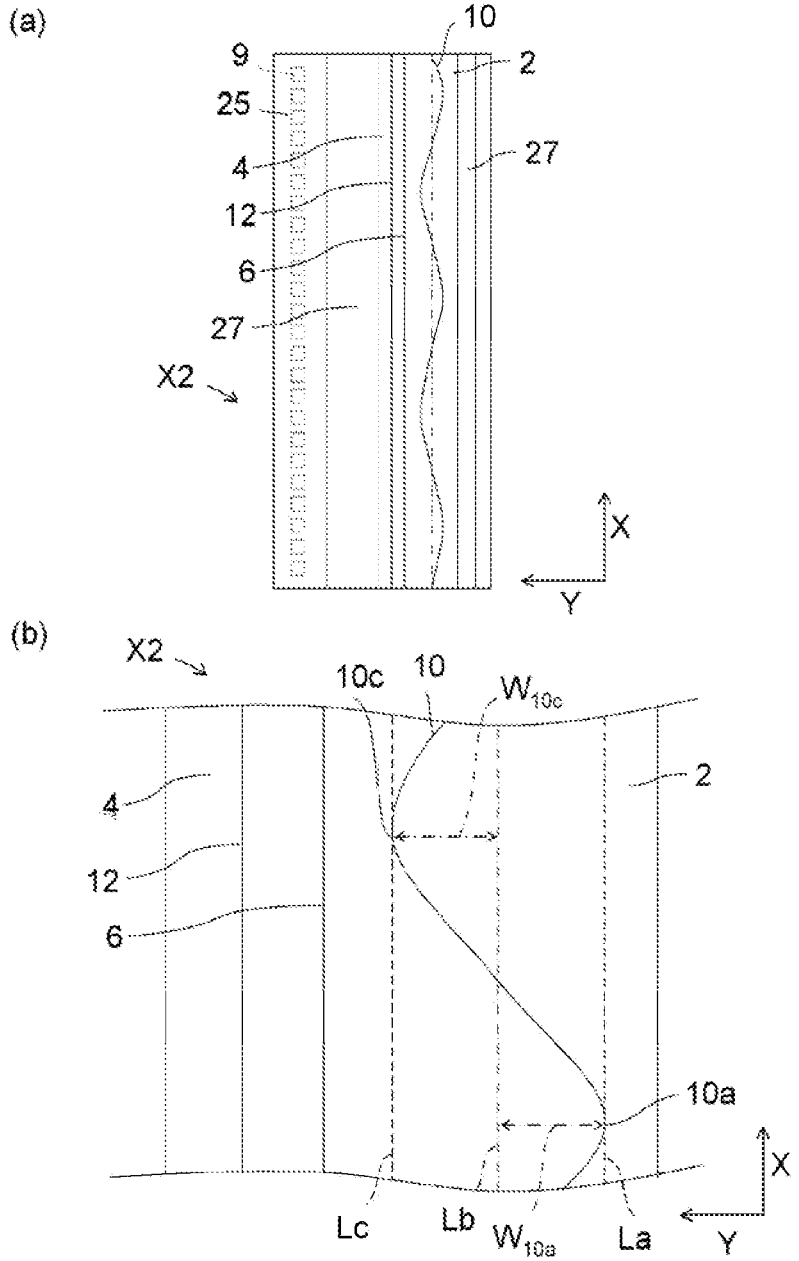
FIG. 7(*a*) is a plan view of the thermal head shown in FIG. 6, and FIG. 7(*b*) is an enlarged plan view of part of the thermal head.
Figure 8:
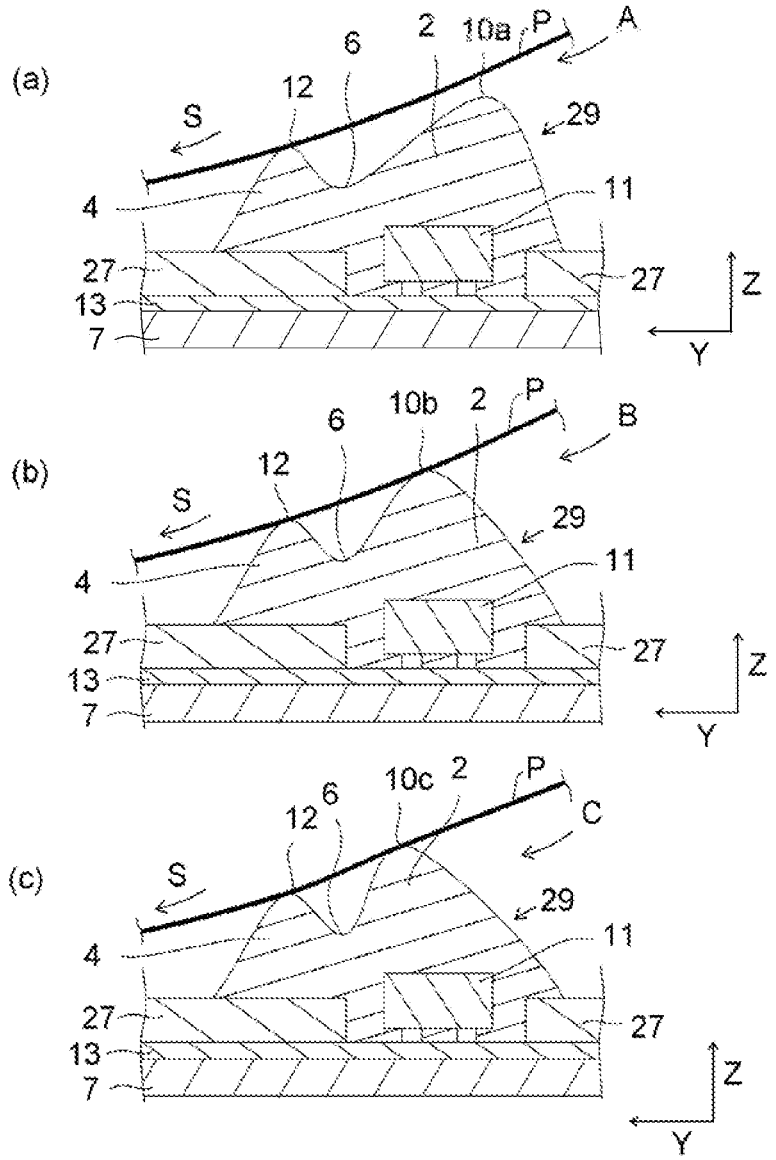
FIG. 8(*a*) is a sectional view taken along the line IV-IV shown in FIG. 6.

A thermal head X2 will be described with reference to FIGS. 6 to 3. Alternate long and short dashed lines as shown in FIGS. 6 to 8 represent imaginary lines passing above the center of gravity of the driving IC 11.

In the thermal head X2, in a plan view, an edge 10 of the first protrusion 2 which makes contact with the recording medium P has a corrugated shape. Moreover, in a plan view, an edge 12 of the second protrusion 4 which makes contact with the recording medium P is substantially perpendicular to the sub scanning direction Y. As employed herein, the phrase "substantially perpendicular to the sub scanning direction Y" means that the angle defined by the sub scanning direction Y and the edge 12 is set to 30±15°, which encompasses the range of allowable manufacturing errors.

In a plan view, the first protrusion 2 comprises: a first extending part 10*c* extending toward the heat generating portion 9; and a second extending part 10*a* extending away from the heat generating portion 9. The first extending part 10*c* and the second extending part 10*a* are disposed alternately in the main scanning direction X. Thus, in a plan view, the first protrusion 2 has the edge 10 of corrugated configuration.

In the thermal head X2, in a plan view, the edge 10 of the first protrusion 2 which makes contact with the recording medium P has a corrugated shape, wherefore the condition of contact between the recording medium P being conveyed over the first protrusion 2 and the edge 10 of the first protrusion 2 varies depending on positions in the main scanning direction X.

Specifically, the condition involves: a condition A where the edge 10 of the first protrusion 2 is located upstream of a point situated above the center of gravity of the driving IC 11 in the sub scanning direction Y (refer to FIG. 8 (*a*)); a condition B where the edge 10 of the first protrusion 2 is located above the center of gravity of the driving IC 11 in the sub scanning direction Y (refer to FIG. 8(*b*)); and a condition C where the edge 10 of the first protrusion 2 is located downstream of the point situated above the center of gravity of the driving IC 11 in the sub scanning direction Y (refer to FIG. 8 (*c*)).

As shown in FIG. 8(*a*), in the condition A, the edge 10 of the first protrusion 2 (the second extending part 10*a*) is not kept in contact with the recording medium P. As shown in FIG. 8(*b*), in the condition B, the edge 10*b* of the first protrusion 2 is kept in contact with the recording medium P. As shown in FIG. 8(*c*), in the condition C, the edge 10 of the first protrusion 2 (the first extending part 10*c*) is kept in contact with the recording medium P, and also the recording medium P is subjected to a pressing force exerted by the edge 10 of the first protrusion 2.

Thus, in the recording medium P, by virtue of the condition A corresponding to a non-contacting state in the main scanning direction X, the frictional force developed, between the recording medium P and the first protrusion 2 can be reduced. Moreover, by virtue of the conditions B and C corresponding to a contacting state, the first protrusion 2 acts to decrease the possibility that the recording medium P will be pressed toward the substrate 7. Also, the possibility of causing wrinkles in the recording medium P during conveyance can be decreased.

The edge 10 of the first protrusion 2 which makes contact with the recording medium P refers to the uppermost part of the first protrusion 2.

A description will, be given as to the case where, in a plan view, the edge 10 of the first protrusion 2 has a corrugated shape. To begin with, among imaginary lines extending in parallel with the main scanning direction X, an imaginary line which is the first to make contact with the edge 10 of the first protrusion 2 when approaching from the downstream side in the sub scanning direction Y toward the covering member 29 is defined as an imaginary line Lc, and also, an imaginary line which is the first to make contact with the edge 10 of the first protrusion 2 when approaching from the upstream side in the sub scanning direction Y toward the covering member 29 is defined as an imaginary line La. In this case, when a condition where the imaginary line La and the imaginary line Lc do not coincide with each other is achieved, then the fact that the first protrusion 2 has a corrugated edge holds true.

Meanwhile, among the imaginary lines extending in parallel with the main scanning direction X, an imaginary line which is the second to make contact with the edge 10 of the first protrusion 2 when approaching from, the downstream, side in the sob scanning direction Y toward the covering member 29 is defined as an imaginary line Lc2, and also, an imaginary line which is the second to make contact with the edge 10 of the first protrusion 2 when approaching from the upstream side in the sub scanning direction Y toward the covering member 29 is defined as an imaginary line La2. Also in this case, when a condition where the imaginary line La2 and the imaginary line Lc2 do not coincide with each other is achieved, or a condition where the third or succeeding imaginary lines do not coincide with each other is achieved, then it can be said that the first protrusion 2 has a corrugated edge.

It is preferable that the first extending part 10*c* has an extended length $W_{10c}$ of 100 to 300 μm on the downstream side in the sub scanning direction Y with respect to an intermediate line Lb which divides the region between the imaginary line La and the imaginary line Lc into two equal parts. Moreover, it is preferable that the second extending part 10*a* has an extended length $W_{10a}$ of 100 to 300 μm on the upstream side in the sub scanning direction Y with respect to the intermediate line Lb. This helps decrease the possibility of causing wrinkles in the recording medium P during conveyance.

Such a covering member 29 can be produced by, during epoxy resin application using a dispenser as described above, applying the epoxy resin along the main scanning direction X while moving the dispenser periodically in the sub scanning direction Y. Alternatively, the covering member 29 can be produced by applying an epoxy resin in the main scanning direction X using a dispenser, curing the epoxy resin, and polishing the epoxy resin.

Moreover, in the thermal head X2, in a plan view, the edge 12 of the second protrusion 4 which makes contact with the recording medium P is perpendicular to the sub scanning direction Y, wherefore the condition of contact between the second protrusion 4 and the recording medium P can be rendered approximately uniform as seen in the main scanning direction X, thereby feeding the recording medium P remaining in the same state in the main scanning direction X to the heat generating portion 9. This leads to further suppression of a blur in a printed image.

That is, in the thermal head X2, the first protrusion 2 is capable of achieving reduction in frictional force and decreasing the possibility of causing wrinkles in the recording medium P, and also, the second protrusion 4 located on the downstream side in the sub scanning direction Y is capable of rendering the condition of the recording medium P approximately uniform throughout its length along the main scanning direction X. This leads to further suppression of a blur in a printed image.

Third Embodiment

Figure 9:
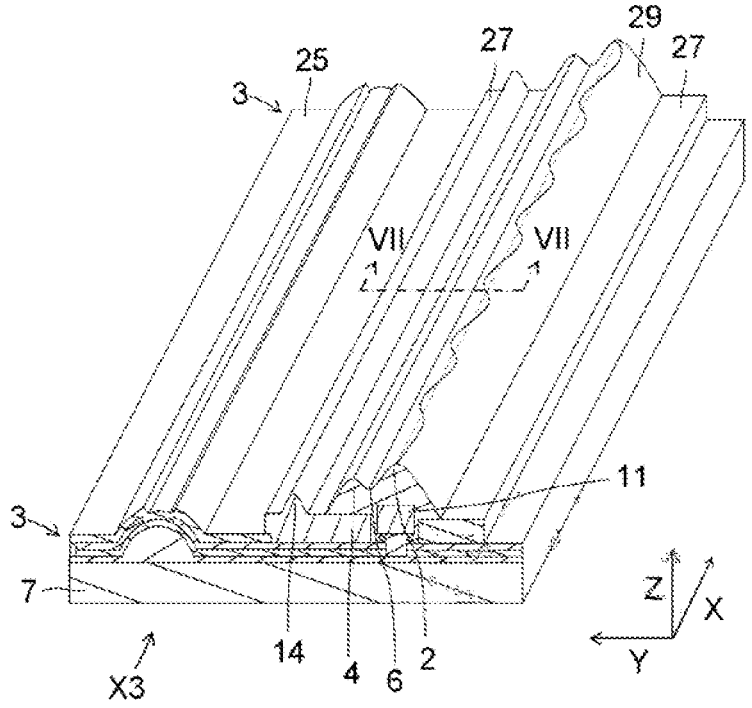
FIG. 9 is a perspective view of a thermal head in accordance with a third embodiment.
Figure 10:
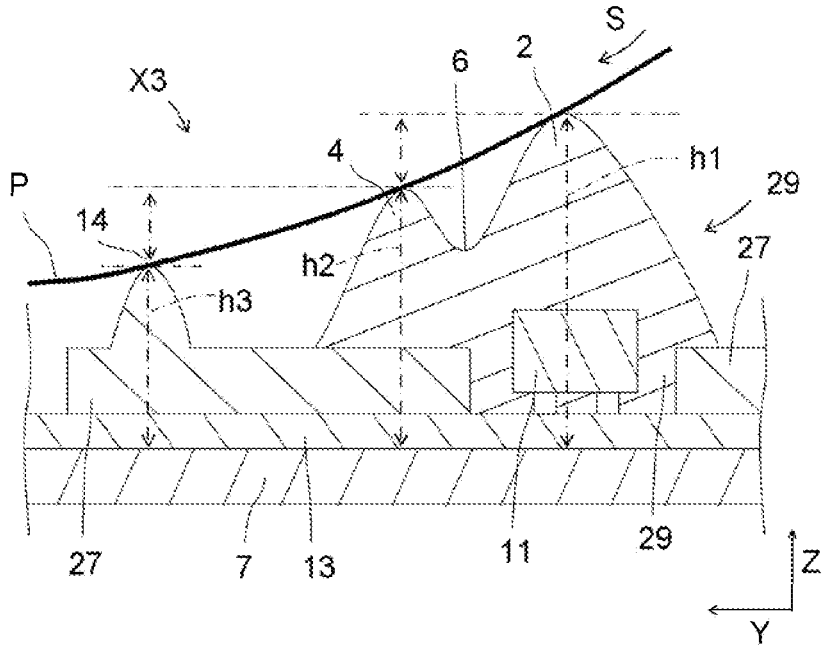
FIG. 10 is a sectional view taken along the line VII-VII shown in FIG. 9.

A thermal head X3 will be described with reference to FIGS. 9 and 10. The thermal head X3 differs in structure from the thermal head X2 in respect of provision of a third protrusion 14 in the cover layer 27, and is otherwise similar to the thermal head X2.

The third protrusion 14 extends in a direction away from the substrate 7 with a protruding height 23 from the substrate 7. The protruding height h3 of the third protrusion 14 is less than the protruding height h2 of the second protrusion 4. That is, in this structure, the second protrusion 4 located on the upstream side in the sub scanning direction Y is greater in height than the third protrusion 14 located on the downstream side in the sub scanning direction Y. Therefore, as the recording medium P is being carried from the upstream, side toward the downstream side in the sub scanning direction Y, the distance between the recording medium P and the substrate 7 can be gradually shortened, and eventually the level at which the recording medium P is positioned can be approximated to the height of the heat generating portion 9 from the substrate 7, thereby achieving smooth conveyance of the recording medium P toward the heat generating portion 9. It is preferable that the value of h3/h2 falls in the range of 0.03 to 0.2.

Moreover, in the thermal head X3, protruding heights from the substrate 7 of the protrusions gradually become small in the following order: the protruding height h1 of the first protrusion 2, the protruding height h2 of the second protrusion 4, and the protruding height h3 of the third protrusion 14. That is, the protruding heights of the first protrusion 2, the second protrusion 4, and the third protrusion 14 gradually become small in this order from the upstream side toward the downstream side in the sub scanning direction Y. This makes it possible to achieve smooth conveyance of the recording medium P toward the heat generating portion 9.

Moreover, a region which is lower in level than the third protrusion 14 is present between the third protrusion 14 of the cover layer 27 and the covering member 29 in the sub scanning direction Y, and hence, even in the presence of paper debris from the recording medium P, the paper debris can be stored in the region which is lower in level than the third protrusion 14. This helps decrease the possibility of delivering paper debris to the heat generating portion 9.

The third protrusion 14, like the first protrusion 2 and the second protrusion 4, can be formed by a dispenser. It is preferable that the third protrusion 14, which makes contact with the recording medium P, alone is made of a material which is higher in hardness than a material used to form the cover layer 27. This makes it possible to decrease the possibility of causing wear and abrasion in the third protrusion 14.

Although the case where the third protrusion 14 protrudes from the surface of the cover layer 27 is shown herein, the third protrusion 14 may be formed at an end part of the cover layer 27. Specifically, in this case, the third protrusion 14 can be formed by making an edge of the cover layer 27 greater in height than other part of the cover layer 27. This helps facilitate the formation of the third protrusion 14.

Fourth Embodiment

Figure 11:
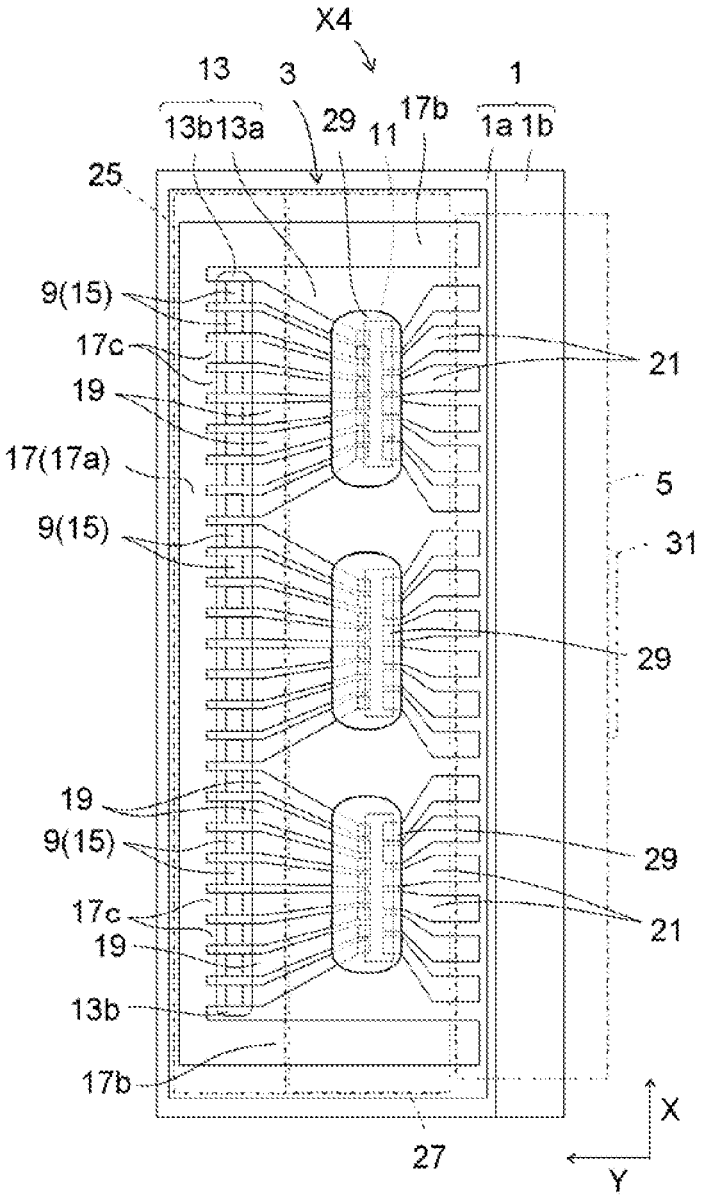
FIG. 11 is a plan view schematically showing a structure of a thermal head in accordance with a fourth embodiment.

As shown in FIG. 11, in a fourth embodiment X4, the covering member 29 is not disposed so as to extend in the main scanning direction X while straddling over the plurality of driving ICs 11, and, there are provided separate covering members 29 for the respective driving ICs. That is, a plurality of covering members 29 are arranged independently of each other in the main scanning direction X.

Also in this case, the covering member 29 comprises a first protrusion (not shown) and a second protrusion (not shown), wherefore the possibility of causing a blur in an image printed on the recording medium P can be decreased.

Fifth Embodiment

Figure 12:
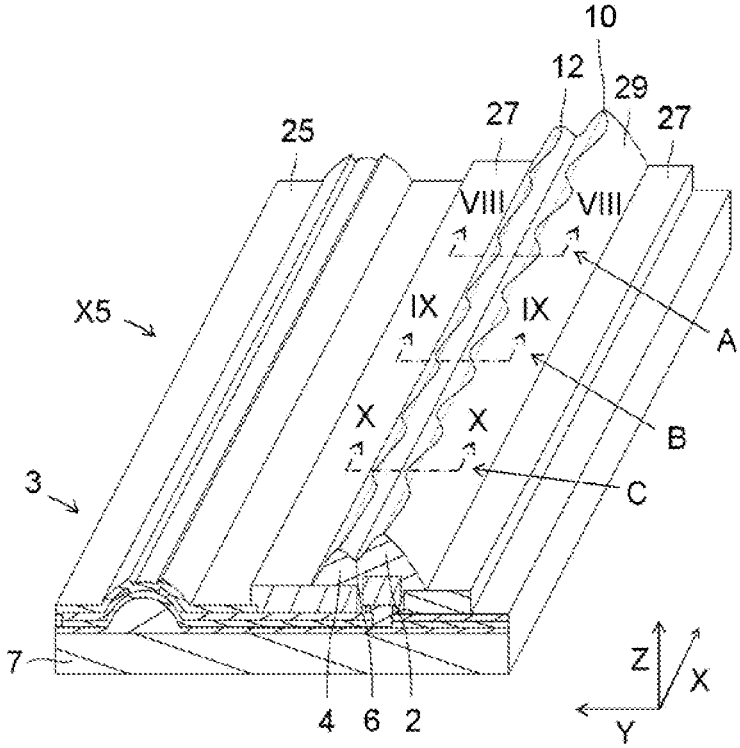
FIG. 12 is a perspective view of a thermal head in accordance with a fifth embodiment.

A thermal head X5 will be described with reference to FIGS. 12 to 14. FIG. 14 corresponds to FIG. 8 pertaining to the second embodiment.

In the thermal head X5, in a plan view, the edge 12 of the second protrusion 4 which makes contact with the recording medium P has a corrugated shape. Moreover, in a plan view, the second protrusion 4 comprises: a third extending part 12*c* extending toward the heat generating portion 9; and a fourth extending part 12*a* extending away from the heat generating portion 9. The third extending part 12*c* and the fourth extending part 12*a* are disposed alternately in the main scanning direction X.

Thus, in the thermal head X5, the condition of contact between the recording medium P and the edge 10 of the first protrusion 2, as well as the edge 12 of the second protrusion 4, varies in the main scanning direction X.

Specifically, the condition involves: a condition A where the edge 10 of the first protrusion 2 is located upstream of a point situated above the center of gravity of the driving IC 11 in the sub scanning direction Y (refer to FIG. 14(*a*)); a condition B where the edge 10 of the first protrusion 2 is located above the center of gravity of the driving IC 11 in the sub scanning direction Y (refer to FIG. 14(*b*)); and a condition C where the edge 10 of the first protrusion 2 is located downstream of the point situated above the center of gravity of the driving IC 11 in the sub scanning direction Y (refer to FIG. 14(*c*)).

Moreover, the condition involves, a condition A where the edge 12 of the second protrusion 4 is located upstream of a point situated above the center of gravity of the driving IC 11 in the sub scanning direction Y (refer to FIG. 14(*a*)); a condition B where the edge 12 of the second protrusion 4 is located above the center of gravity of the driving IC 11 in the sub scanning direction Y (refer to FIG. 14 (*b*)); and a condition C where the edge 12 of the second protrusion 4 is located downstream of the point situated above the center of gravity of the driving IC 11 in the sub scanning direction Y (refer to FIG. 14(*c*)).

Accordingly, as shown in FIG. 14(*a*), in the condition A, neither the edge 10 of the first protrusion 2 (the second extending part 10*a*) nor the edge 12 of the second protrusion 4 (the fourth extending part 12*a*) is kept in contact with the recording medium P. As shown in FIG. 14(*b*), in the condition B, the edge 10*b* of the first protrusion 2 and the edge 12*b* of the second protrusion 4 are kept in contact with the recording medium P. As shown in FIG. 14(*c*), in the condition C, the edge 10 of the first protrusion 2 (the first extending part 10*c*) and the edge 12 of the second protrusion 4 (the third extending part 12*c*) are kept in contact with the recording medium P, and also the recording medium P is subjected to a pressing force exerted by the edge 10*c* of the first protrusion 2.

Thus, in the recording medium P, by virtue of the condition A corresponding to a non-contacting state in the main scanning direction X, the frictional force developed between the recording medium P and the first protrusion 2 as well as the second protrusion 4 can be reduced. Moreover, by virtue of the conditions B and C corresponding to a contacting state, the first protrusion 2 acts to decrease the possibility that the recording medium P will be pressed toward the substrate 7. Also, the possibility of causing wrinkles in the recording medium P during conveyance can be decreased.

Moreover, the first extending part 10*c* and the third extending part 12*c* are arranged adjacent each other in the sub scanning direction Y. Furthermore, the second extending part 10*a* and the fourth extending part 12*a* are arranged adjacent each other in the sub scanning direction Y. Therefore, in a plan view, the edge 10 of the first protrusion 2 and the edge 12 of the second protrusion 4 are disposed in substantially parallel relation to each other.

Thus, the condition of contact between the first protrusion 2 and the recording medium P and the condition of contact between the second protrusion 4 and the recording medium P are substantially the same in the main scanning direction X. This makes it possible to render the contacting state of the recording medium P approximately uniform in the sub scanning direction Y, and thereby decrease the possibility of causing a sticking phenomenon in the recording medium P.

Figure 13:
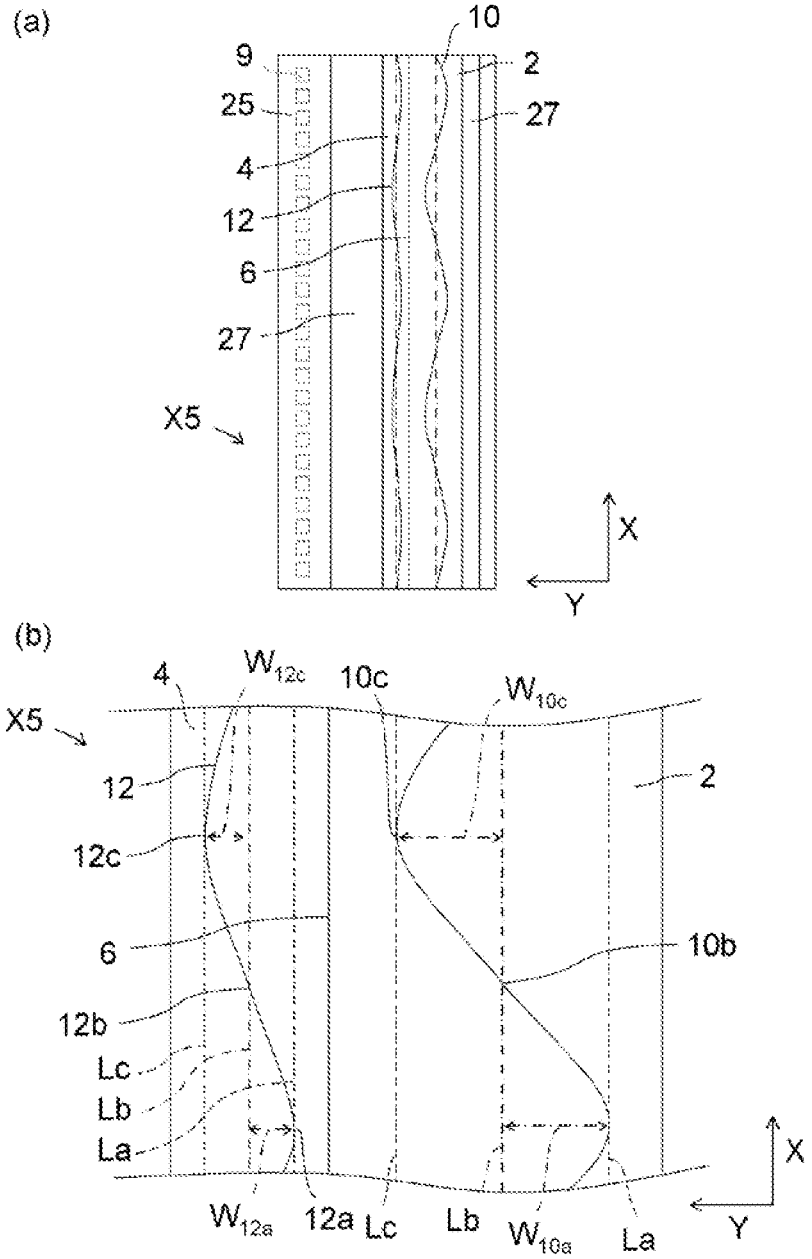
FIG. 13(*a*) is a plan view of the thermal head shown in FIG. 12, and FIG. 13(*b*) is an enlarged plan view of part of the thermal bead.
Figure 14:
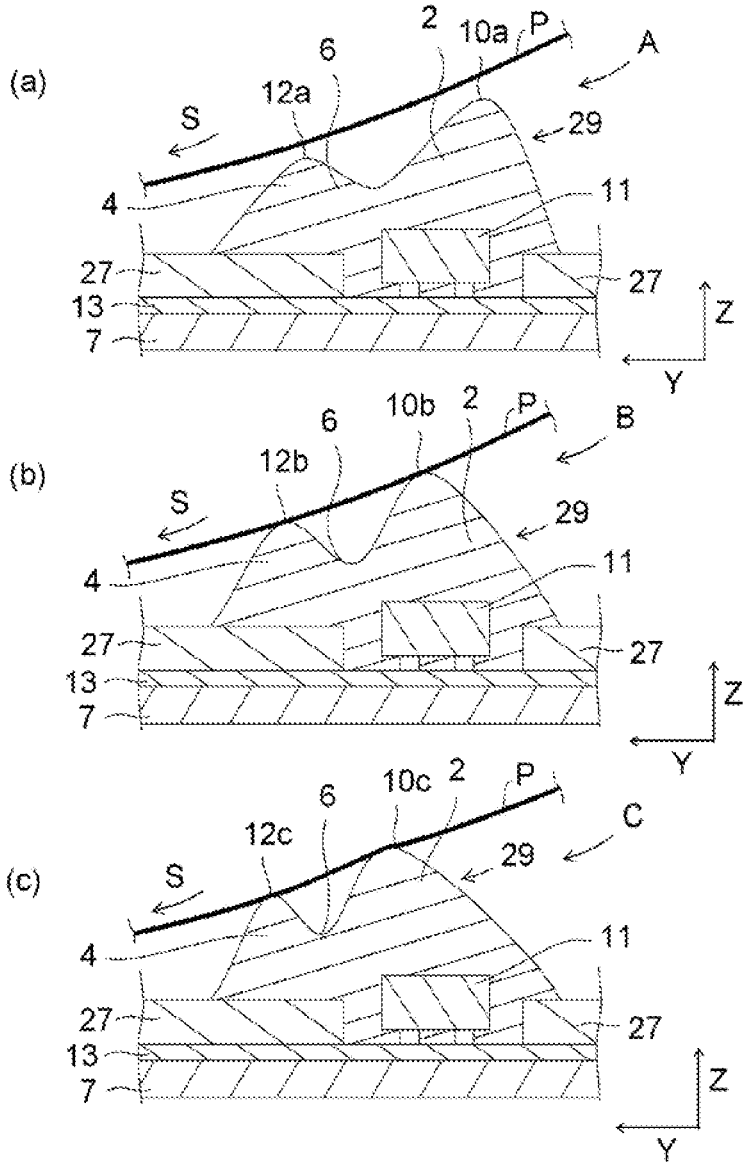
FIG. 14(*a*) is a sectional view taken along the line VIII-VIII shown in FIG. 12.

Moreover, as shown in FIG. 13(*b*), an extended length $W_{10c}$ of the first extending part 10*c* is longer than an extended length $W_{12c}$ of the third extending part 12*c*, and, an extended length $W_{10a}$ of the second extending part 10*a* is longer than an extended length $W_{12a}$ of the fourth extending part 12*a*.

Accordingly, there arise large positional variations of the edge 10 of the first protrusion 2 which is the first to make contact with the recording medium P among the protrusions, in the sub scanning direction Y, as seen in the main scanning direction X. Thus, the condition of contact between the recording medium P and the edge 10 of the first protrusion 2 in the main scanning-direction X is varied greatly. As a result, even at the time of sticking-prone first contact between the recording medium P and the thermal head X5, the possibility of occurrence of sticking can be decreased.

Moreover, there arise small positional variations of the edge 12 of the second protrusion 2 disposed in the vicinity of the heat generating portion 9 in the sub scanning direction Y, as seen in the main scanning direction X. Accordingly, the condition of contact between the recording medium P and the edge 12 of the second protrusion 4 in the main scanning direction X is varied slightly. As a result, since variations of the condition of contact between the recording medium P and the edge 12 of the second protrusion 4 in the main scanning direction X are small in the vicinity of the heat generating portion 9 subjected to a great pressing force, it is possible to convey the recording medium P remaining in a uniform condition in the main scanning direction X onto the heat generating portion 9.

The edge 12 of the second protrusion 4 which makes contact with the recording medium P refers to the uppermost part of the second protrusion 4. In a plan view, the corrugated shape of the edge 12 of the second protrusion 4 is equivalent to the corrugated shape of the edge 10 of the first protrusion as described above.

It is preferable that the third extending part 12*c* has an extended length $W_{12c}$ of 100 300 μm on the downstream side in the sub scanning direction Y with respect to an intermediate line Lb which divides the region between an imaginary line La and an imaginary line Lc into two equal parts. Moreover, it is preferable that the fourth extending part 12*a* has an extended length $W_{12a}$ of 100 to 300 μm on the upstream side in the sub scanning direction Y with respect to the intermediate line Lb. This helps decrease the possibility of causing wrinkles in the recording medium P during conveyance.

Figure 15:
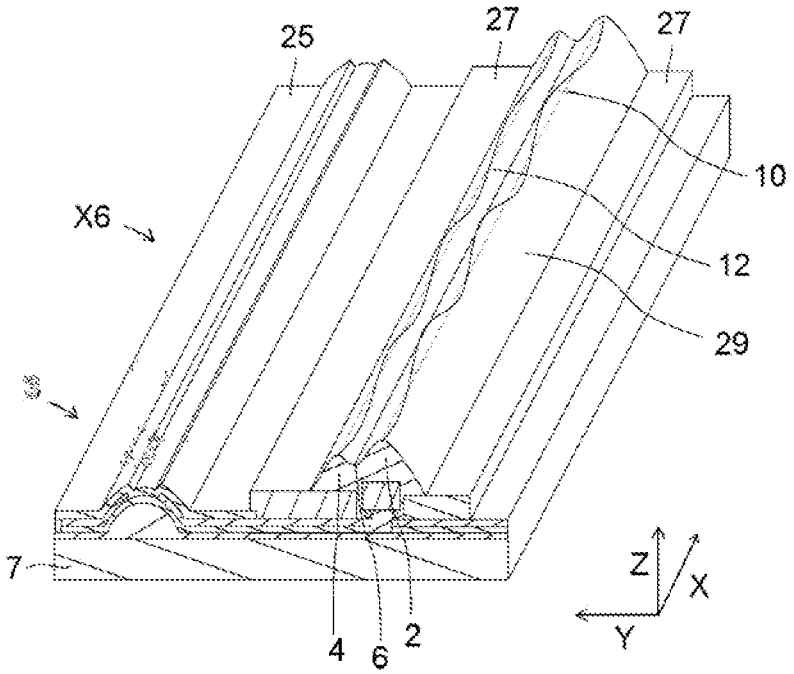
FIG. 15 is a perspective view showing a modified example of the thermal head of the fifth embodiment.

It is noted that, as with the case with a thermal head X6 shown in FIG. 15, the edge 10 of the first protrusion 2 may have a corrugated shape when viewed laterally. Moreover, the edge 12 of the second protrusion 4 may have a corrugated shape when viewed laterally.

Also in such a case, the condition of contact between the recording medium P and the edge 10 of the first protrusion 2, as well as the edge 12 of the second protrusion 4, varies in the main scanning direction X, wherefore the possibility of causing wrinkles in the recording medium P during conveyance can be decreased.

While several embodiments have been described heretofore, it should be understood that the application of the invention is not limited to the embodiments thus far described, and that many modifications and variations of the invention are possible without departing from the scope of the invention. For example, although the above description deals with the thermal printer Z1 employing the thermal head X1 implemented as the first embodiment, the construction is not limited to this, and thus the thermal heads X2 to X6 may be adopted for use in the thermal printer Z1. Moreover, the thermal heads X1 to X6 implemented as several embodiments may be used in combination.

Moreover, in the thermal head X1, the protuberant portion 13*b* is formed in the heat storage layer 13, and the electrical resistance layer 15 is formed on the protuberant portion 13*b*, but, this does not suggest any limitation. For example, the heat generating portion 9 of the electrical resistance layer 15 may be placed on the underlayer portion 13*b* of the heat storage layer 13 without forming the protuberant portion 13*b* in the heat storage layer 13. In another alternative, the electrical resistance layer 15 may be placed on the substrate 7 without forming the heat storage layer 13.

Moreover, in the thermal head X1, the common electrode 17 and the individual electrode 19 are formed on the electrical resistance layer 15, but, the construction is not limited so long as both of the common electrode 17 and the individual electrode 19 are connected to the heat generating portion 9 (electric resistor). For example, the heat generating portion 9 may be constructed, by forming the common electrode 17 and the individual electrode 19 on the heat storage layer 13, and subsequently forming the electrical resistance layer 15 only in a region between the common electrode 17 and the individual electrode 19.

Furthermore, although the above description deals with the case of performing patterning on the electrical resistance layer 15 in the form of a thin film to obtain various electrode patterns, the construction is not limited to this. For example, the electrical resistance layer 15 in the form of a thick film may be provided after performing patterning on the heat storage layer to obtain various electrode patterns.

REFERENCE SIGNS LIST

X1-X6: Thermal head
Z1: Thermal printer
1: Heatsink
2: First protrusion
3: Head substrate
4: Second protrusion
5: Flexible printed wiring board
6: Recess
7: Substrate
8: Gap
9: Heat generating portion, (electric resistor)
10: Edge of first protrusion
11: Driving IC
12: Edge of second protrusion
13: Heat storage layer
14: Third protrusion
15: Electrical resistance layer
17: Common electrode
19: Individual electrode
21: Connection electrode
23: Joining material
25: Protective layer
27: Cover layer
29: Covering member

The invention claimed is:

1. A thermal head, comprising:
a substrate;
a plurality of heat generating portions disposed aligned on the substrate;
an electrode disposed on the substrate so as to be electrically connected to the heat generating portions;
a driving IC electrically connected to the electrode; and
a covering member which covers an entire surface of the driving IC and is formed of a resin cured body,
the covering member including
a first protrusion extending in a direction away from the substrate; and
a second protrusion which is spaced from the first protrusion, is located between the first protrusion and the heat generating portions, and extends in a direction away from the substrate.

2. The thermal head according to claim 1,
wherein a protruding height of the first protrusion with respect to the substrate is greater than a protruding height of the second protrusion with respect to the substrate.

3. The thermal head according to claim 1
wherein the covering member has a recess existing between the first protrusion and the second protrusion.

4. The thermal head according to claim 1,
wherein the driving IC is located in a lower part of the first protrusion.

5. The thermal head according to claim 1,
wherein the covering member is disposed so as to extend in an arrangement direction of the heat generating portions.

6. The thermal head according to claim 5,
wherein, in a plan view, an edge of an uppermost part of the first protrusion has a corrugated shape.

7. The thermal head according to claim 6,
wherein, in a plan view, the first protrusion includes a first extending part extending toward the heat generating portions and a second extending part extending away from the heat generating portions, and
the first extending part and the second extending part are disposed alternately in the arrangement direction of the heat generating portions.

8. The thermal head according to claim 6,
wherein, in a plan view, an edge of an uppermost part of the second protrusion is substantially perpendicular to a conveyance direction in which the recording medium is conveyed.

9. The thermal head according to claim 7,
wherein, in a plan view, an edge of an uppermost part of the second protrusion has a corrugated shape.

10. The thermal head according to claim 9,
wherein, in a plan view, the second protrusion includes a third extending part extending toward the heat generating portions and a fourth extending part extending away from the heat generating portions, and
the third extending part and the fourth extending part are disposed alternately in an arrangement direction of the heat generating portions.

11. The thermal head according to claim 10,
wherein the first extending part and the third extending part are disposed adjacent each other in a sub scanning direction of the heat generating portions, and the second extending part and the fourth extending part are disposed adjacent each other in the sub scanning direction of the heat generating portions.

12. The thermal head according to claim 11,
wherein an extended length of the first extending part is longer than an extended length of the third extending part, and an extended length of the second extending part is longer than an extended length of the fourth extending part.

13. The thermal head according to claim 1, further comprising:
a cover layer disposed between the heat generating portions and the covering member,
wherein the cover layer has a third protrusion extending in a direction away from the substrate.

14. The thermal head according to claim 13,
wherein a protruding height of the third protrusion with respect to the substrate is less than the protruding height of the second protrusion with respect to the substrate.

15. A thermal printer, comprising:
the thermal head according to claim 1;
a conveyance mechanism of conveying the recording medium onto the heat generating portions; and
a platen roller which presses the recording medium onto the heat generating portions.

16. A thermal head, comprising:
a substrate;
a plurality of heat generating portions disposed aligned on the substrate;
an electrode disposed on the substrate so as to be electrically connected to the heat generating portions;
a driving IC electrically connected to the electrode; and
a covering member which covers the driving IC,
the covering member including
a first protrusion extending in a direction away from the substrate; and a second protrusion which is spaced from the first protrusion, is located between the first protrusion and the heat generating portions, and extends in a direction away from the substrate, the covering member being disposed so as to extend in an arrangement direction of the heat generating portions, in a plan view, an edge of an uppermost part of the first protrusion having a corrugated shape.

17. The thermal head according to claim 16, wherein, in a plan view, an edge of an uppermost part of the second protrusion has a corrugated shape.

18. A thermal printer, comprising:

the thermal head according to claim 16;

a conveyance mechanism of conveying the recording medium onto the heat generating portions; and a platen roller which presses the recording medium onto the heat generating portions.

19. A thermal head, comprising:

a substrate;

a plurality of heat generating portions disposed aligned on the substrate;

an electrode disposed on the substrate so as to be electrically connected to the heat generating portions;

a driving IC electrically connected to the electrode; and a covering member which covers the driving IC, the covering member including a first protrusion extending in a direction away from the substrate, in a plan view, an edge of an uppermost part of the first protrusion having a corrugated shape.

20. A thermal printer, comprising:

the thermal head according to claim 19;

a conveyance mechanism of conveying the recording medium onto the heat generating portions; and a platen roller which presses the recording medium onto the heat generating portions.

* * * * *